US005370205A

United States Patent [19]

Vanhala

[11] Patent Number: 5,370,205

[45] Date of Patent: Dec. 6, 1994

[54] TRACTION SHEAVE ELEVATOR

[75] Inventor: Timo Vanhala, Riihimäki, Finland

[73] Assignee: Kone Elevator GmbH, Baar, Switzerland

[21] Appl. No.: 85,814

[22] Filed: Jul. 6, 1993

[30] Foreign Application Priority Data

Jul. 7, 1992 [FI] Finland ..... 923113

[51] Int. Cl.[5] ..... B66B 11/08

[52] U.S. Cl. ..... 187/264; 187/266

[58] Field of Search ..... 187/20, 26, 27

[56] References Cited

U.S. PATENT DOCUMENTS

| | | | |
|---|---|---|---|
| 669,603 | 3/1901 | Stauffacher | 187/20 |
| 691,276 | 1/1902 | Köttgen | 187/20 |
| 772,005 | 10/1904 | Sundh et al. | 187/20 X |
| 1,047,330 | 12/1912 | Sundh | 187/20 |
| 1,085,952 | 2/1914 | Sundh | 187/20 |
| 1,974,361 | 9/1934 | La Neve | 187/20 X |
| 4,753,322 | 6/1988 | Yasuda | 187/20 |
| 4,807,723 | 2/1989 | Salmon et al. | 187/20 |
| 4,842,101 | 6/1989 | Lamb | 187/22 |
| 5,025,893 | 6/1991 | Saito | 187/20 |

FOREIGN PATENT DOCUMENTS

| | | | |
|---|---|---|---|
| 995156 | 8/1976 | Canada | 187/20 X |
| 1000216 | 11/1976 | Canada | 187/20 X |

*Primary Examiner*—Cheryl L. Gastineau
*Assistant Examiner*—Dean A. Reichard

[57] ABSTRACT

Traction sheave elevator comprising a drive machine (10), a traction sheave (7) connected to the drive machine, two diverting pulleys (5,6), an elevator car (1), a counterweight (2) and a hoisting rope rigging (3) on which rigging the elevator car and its counterweight are suspended. Each deflection of a hoisting rope in the rigging (3) takes place along a circular path determined by a rope groove on the traction sheave (7) or a diverting pulley (5 and 6), occurs in essentially the same direction with respect to the direction of the shafts of the traction sheave and diverting pulleys.

8 Claims, 4 Drawing Sheets

5
6
12
12
7
3
L
1
20
20
4
4
2

TRACTION SHEAVE ELEVATOR

FIELD OF THE INVENTION

The present invention relates to a traction sheave elevator.

DESCRIPTION OF THE BACKGROUND ART

To save space, the elevators installed in tall buildings are generally designed for fast operation and heavy use. These elevators are required to have a high transport capacity. The number of starts in a year may amount to several hundred thousand. Fast elevators and elevators with a large travel height are generally implemented as traction sheave elevators. The hoisting ropes connecting the elevator car and the counterweight of a traction sheave elevator usually run over the traction sheave and at least one diverting pulley. The hoisting motor of the elevator imparts rotation to the traction sheave either directly or via a gear. The rotary motion of the traction sheave is converted into longitudinal motion of the ropes by means of the friction between the traction sheave and the ropes. Creating a large frictional effect between the traction sheave and the ropes promotes the usability of the elevator. A large frictional effect is achieved fairly easily by increasing the angle of contact between the ropes and the traction sheave. However, increasing the angle of contact often results in an increased number of deflections, causing wear of the ropes. The strain resulting from deflection is more severe in cases where the ropes are deflected in a direction opposite to that of the previous deflection. Such a deflection is termed reverse deflection. The deflections may take place in the plane of the traction sheave or in the planes of the diverting pulleys guiding the ropes. Moreover, the ropes may also be deflected in an oblique direction from the plane of rotation of the pulley as they enter onto the pulley or leave it. This deflection is referred to as skew traction angle. The grip of the ropes on the traction sheave can be increased by increasing the coefficient of friction between the rope and the traction sheave, or by shaping the rope grooves of the traction sheave so that the ropes will be compressed in the grooves. However, a disadvantage is that increasing the friction coefficient and compression of the rope through the shaping of the groove result in a reduction cf the service life of the ropes and the traction sheave, especially of the rope grooves of the sheave.-The abrasion can be reduced by increasing the size of and the distance between the traction sheave and the diverting pulleys, but such a solution would result in increased manufacturing costs. Also, the assembly formed by the elevator machine and its bed and the traction sheave and diverting pulleys would be so large that it would be difficult or impossible to house it in a conventional elevator machine room. Even with the present sizes of traction sheaves and diverting pulleys, it necessary to use lefthand and righthand types of machine and machine bed to enable all the required equipment to be fitted in machine rooms which are often very small.

In a previously known traction sheave elevator, presented by Finnish patent 56813, the ropes connecting the counterweight and the elevator car are deflected by a diverting pulley onto the traction sheave and run around it bending in the opposite direction, whereupon they run further back into the elevator shaft, possibly over another diverting pulley. The angle of contact of the ropes is 210°–250° and the skew traction angle of the ropes entering and those leaving the traction sheave is 1° from the plane of rotation of the sheave to ensure that the ropes will not touch each other at the crossover point. The rope grip is further improved by undercutting the rope grooves of the traction sheave. In its time, the solution presented by Finnish patent 56813 allowed economies with respect to space as it made it possible to use a smaller traction sheave than before, which further permitted lighter machine structures. Finnish patent number 84051 presents a traction sheave elevator in which the skew traction angle resulting from ropes-running as in patent 56813 is influenced by tilting and turning the drive machine and its traction sheave so that the ropes meet the diverting pulley in the direction of its plane of rotation.

Finnish patent number 77207 presents a traction sheave elevator in which the ropes run similarly to the single-wrap traction sheave elevator of Finnish Patent 56813 except that the ropes run from the traction sheave to an additional diverting pulley and back to the traction sheave before being passed back into the shaft. The result is a so-called double-wrap elevator in which the contact angle may be 400°–540°. The large contact angle ensures a good frictional grip even if half-round rope grooves are used in the traction sheave.

SUMMARY OF THE INVENTION

To achieve a decreased rope wear while at the same time ensuring sufficient rope grip on the traction sheave as well as a compact machine/bed assembly with traction sheave and diverting pulleys, a new type of traction sheave elevator is presented as an invention. The traction sheave elevator of the invention is characterized by each deflection of each hoisting rope in the rigging takes place along a circular path determined by a rope groove in the traction sheave or a diverting pulley and occurs in essentially the same direction with respect to the direction of the shafts of the traction sheave and diverting pulleys.

An important advantage achieved by the traction sheave elevator of the invention is an extended service life of the hoisting ropes, because the ropes undergo no reverse deflections around the traction sheave and diverting pulleys but run around them in the same direction. A rope arrangement like this, where successive deflections of the ropes take place in the same direction, is called forward deflection. Moreover, the solution of the invention makes it easy to produce an elevator machine bed design in which no separate right-hand and left-hand machines and machine beds are needed but uniform machines and beds are sufficient for all conventional solutions. The solution of the invention can be implemented using a smaller machine room floor area than earlier solutions. Therefore, even the machine room of the elevator can be made smaller, leaving more space for other purposes in the building. The compact size of the elevator machine and the associated machine bed again renders the solution particularly applicable for elevator modernizations. Installing the elevator of the invention is a simple operation as compared to several other elevators having an equal contact angle between the hoisting rope and the traction sheave.

A further advantage worth noting is that, according to the invention, the traction sheave elevator can easily be so designed that the ropes will run in the direction of the rope grooves of the diverting pulleys when meeting the latter, which is another feature reducing rope wear.

In several embodiments of the invention, the ropes coming to the traction sheave and those leaving it meet a diverting pulley next, so in these embodiments the possible swing of the rope portions going down to the elevator car or to the counterweight has practically no effect on the manner in which the traction sheave meets the hoisting ropes. In this way, an accurate arrangement for guiding the ropes coming to and those leaving the traction sheave is achieved, from which it follows that the ropes can be very close to each other at the crossover point, yet without touching each other. Therefore, with the present invention, a small skew traction angle, of the order of 1°, can easily be achieved. For the same reason, the degree of accuracy required in the installation of the machine can be lower, thus considerably reducing the time needed for installation.

Yet another notable advantage is that, although the rope coming to the traction sheave and the rope leaving it are subject to skew traction forces, these are equal and act on different sides of the plane of rotation of the traction sheave, so they cancel each other. Consequently, no axial forces are applied to the traction sheave or its shaft. A further advantage is that the useful life of the rope and the traction sheave is extended because the rope and the groove of the rope pulley will be abraded more evenly and from both sides, not from one side only as would be the case if skew traction should occur only to one side with respect to the plane of rotation of the traction sheave.

Yet another advantage worth mentioning is the fact that the ropes come to the traction sheave and leave it in the directions of the planes of rotation of the diverting pulleys, which means that the shafts of the diverting pulleys can be parallel to each other. This makes the installation of the hoisting machine and ropes considerably simpler and easier.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention is described in detail by the aid of an example by referring to the attached drawings which are given by way of illustration only, and thus are not limitative of the present invention, and in which.

DETAILED DESCRIPTION OF THE PREFERRED EMBODIMENTS

Figure 1:
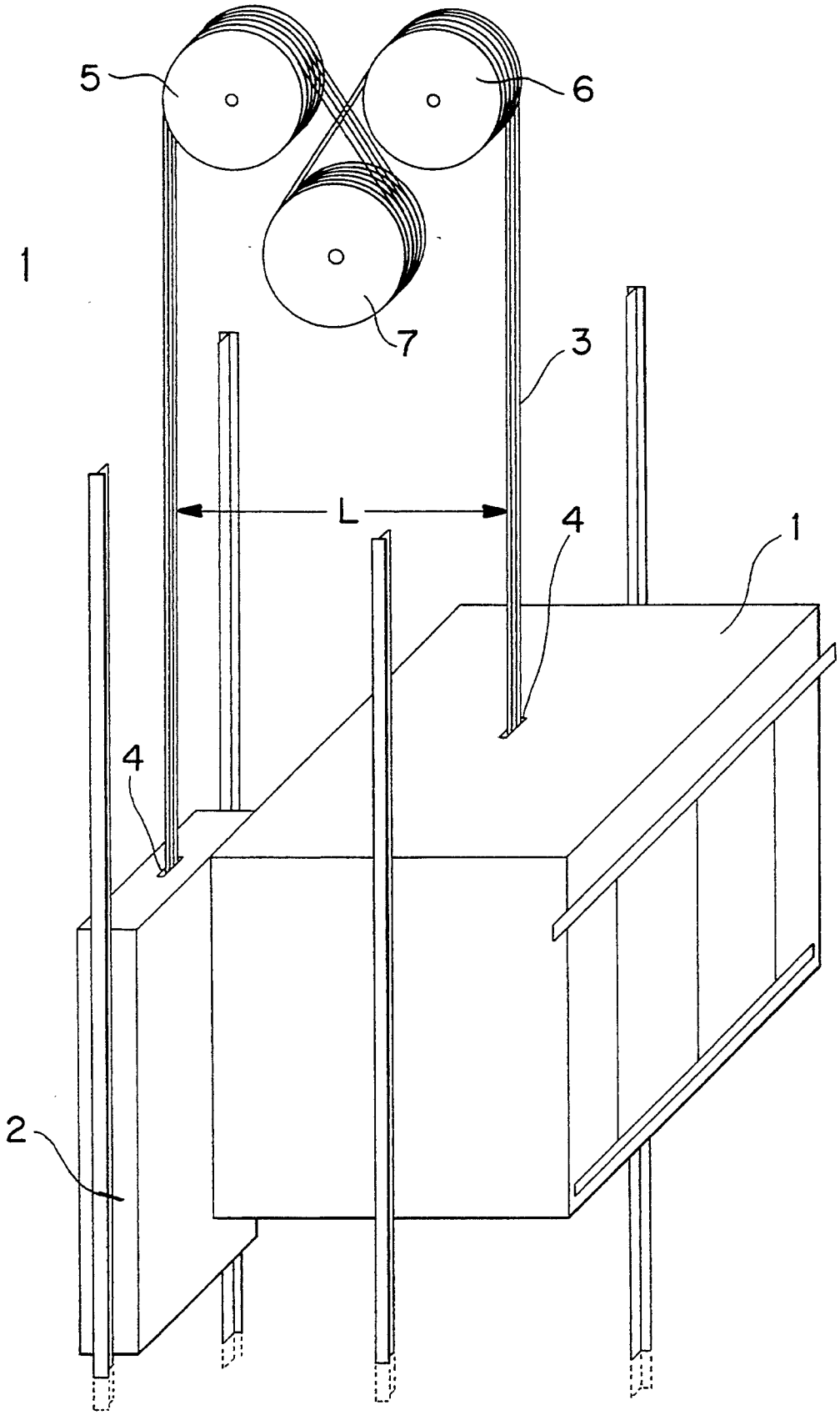
FIG. 1 presents the traction sheave elevator of the invention in diagrammatic form.

In the diagram of FIG. 1 representing the traction sheave elevator of the invention, the elevator car I and the counterweight 2 are connected by the hoisting ropes 3 (rigging) of the elevator. The elevator car and the counterweight travel along guide rails mounted in an elevator shaft. Mounted on a machine bed in a machine room above the shaft are an elevator drive machine and diverting pulleys 5, 6 with rope grooves. The drive machine is provided with a traction sheave 7 with rope grooves. The drive machine causes the traction sheave to rotate, thereby imparting a motion to the hoisting ropes. The machine room and machine bed are not shown in the figure. The hoisting rope rigging consists of a number of adjacent ropes fixed to rope anchors 4 provided in the elevator car and the counterweight. The hoisting ropes 3 between the elevator car and the counterweight run through a wheelwork consisting of the traction sheave and the diverting pulleys, each individual rope running along circular paths determined by the rope grooves on the circumference of the traction sheave and diverting pulleys. The traction sheave 7 is placed below the horizontal line between the diverting pulleys 5,6. The ropes 3, fixed by one end to the counterweight 2, first run upwards from the shaft over one 5 of the diverting pulleys and further around the traction sheave 7 to the other diverting pulley 6, passing over it and then going back down into the elevator shaft, where the ropes are attached by their other end to the elevator car 1.

A contact angle of over 180° is achieved by using an arrangement in which the ropes run across themselves between the traction sheave and the diverting pulleys. The planes of rotation of the traction sheave and diverting pulleys are so placed and directed relative to each other that the ropes will not hit themselves or each other. The rope running in each groove of the traction sheave comes into the groove from one side of the plane determined by the groove and departs from the groove to the other side of said plane. In this way, both the rope coming to the traction sheave and the rope leaving it are subject to skew traction forces, which are preferably adjusted to equal values so that they will cancel each other, generating no forces acting in the axial direction of the traction sheave. On the diverting pulleys, each rope enters and leaves the rope groove in the direction of the groove, so no skew traction occurs. Naturally, the distances between the rope grooves on the traction sheave 7 and diverting pulleys 5,6 are such that the clearance between ropes running in adjacent grooves is larger than the diameter of the ropes.

Observing the traction sheave elevator of FIG. 1 in a situation when the elevator car is moving downwards, it will be seen that the traction sheave 7 and diverting pulleys 5,6 rotate in the clockwise diretion, and when the elevator car is moving upwards, they rotate in the anticlockwise direction as seen from the angle of view presented in FIG. 1. From FIGS. 1 and 2*a*–2*d*, it is easy to see that each deflection of each hoisting rope along a circular path determined by the rope groove takes place in essentially the same direction relative to the momentary direction of motion of the ropes 3. In other words, all deflections of the ropes the rigging 3 along the circular arcs formed by the rope grooves of the traction sheave 7 and diverting pulleys 5,6 are forward deflections, and no reverse deflections occur. It can be seen from FIG. 1 that the traction sheave and diverting pulleys are located within the rope distance L, i.e. between the positions of the rope portions going to the elevator car and to the counterweight.

FIGS. 2*a*, 2*b*, 2*c* and 2*d* present different variations of the rigging arrangement in the traction sheave elevator of the invention. The passage of the ropes in each FIG.

Figure 2A:
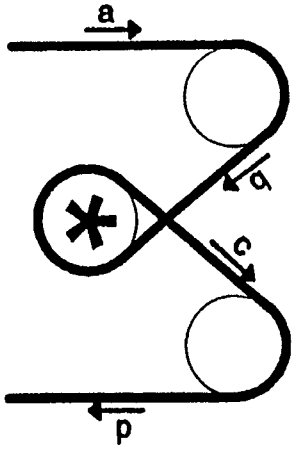
FIGS. 2*a*–2*d* present certain rope arrangements according to the invention.
Figure 2B:
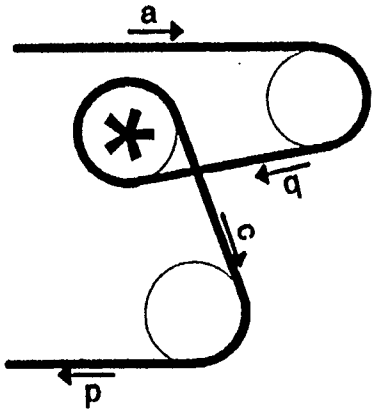
Figure 2C:
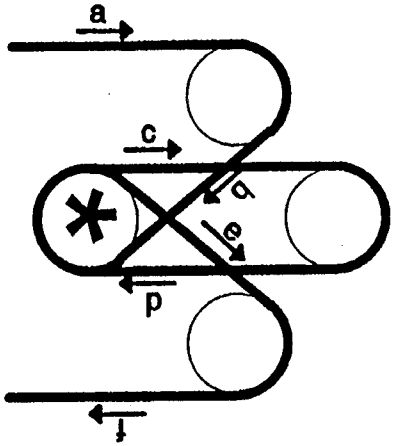
Figure 2D:
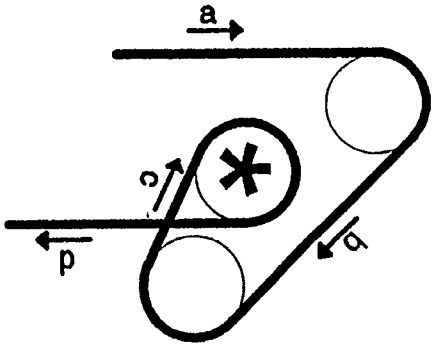

2a–2d is indicated by arrows, one being placed against each rope section separated by pulleys. The arrows point in a direction along the ropes away from the counterweight towards the elevator car. In each FIG. 2a–2d, the arrows indicate the running direction of each section of the rigging as the elevator car is travelling downwards. Thus, depending on whether the ropes are moving towards the elevator car or towards the counterweight, the momentary direction of deflection around the wheels along the ropes is either clockwise or anticlockwise. In the case of an elevator car travelling upwards, the arrows in FIGS. 2a–2d point in a direction opposite to the running direction of the ropes. In each figure, the arrows are designated by letters a,b,c . . . in succession, starting from the rope section coming from the counterweight and ending up with the rope section going to the elevator car. For the sake of clarity, the traction sheave is marked with an asterisk (*) in each FIG. 2a–2d. FIG. 2a presents a simplified view of the wheelwork according to FIG. 1 and the passage of the ropes around the wheels. FIG. 2b presents a solution according to the invention in which the wheelwork is so inclined that the diverting pulleys are at different heights. In this way it is possible to achieve a narrower rope distance than in the solution of FIG. 2a while still retaining the same size and mutual distances of the traction sheave and diverting pulleys. Retaining the same size and distances is not necessary as regards the invention, but it is an obvious consequence if during installation the rope distance is adjusted by tilting the machine bed. In FIGS. 2a and 2b, the ropes run from the counterweight to the first diverting pulley, further to the traction sheave, to the second diverting pulley and finally to the elevator car. FIG. 2c presents a variation of the invention in which the contact angle has been increased by adding a third diverting pulley. In this case, the contact angle is not continuous as in the previous figures but consists of two separate portions. The ropes run from the counterweight to the first diverting pulley, further to the traction sheave, to the third diverting pulley, back to the traction sheave, then to the second diverting pulley and finally to the elevator car. By using a double-wrap solution like this, it is possible, within the framework of the basic idea of the invention, to increase the contact angle even to a value double the size of the contact angle in the solutions presented in FIGS. 1, 2a and 2b. The traction sheave of a double-wrap elevator has twice as many rope grooves as a single-wrap elevator. A double-wrap elevator could also be implemented by using an arrangement in which, in addition to the traction sheave, one of the diverting pulleys as presented in FIGS. 1, 2a and 2b is provided with a double number of rope grooves and the ropes coming from the traction sheave return from this diverting pulley back to the traction sheave and again from the traction sheave to this pulley, from which they pass further into the elevator shaft. This extra wrap around the traction sheave and a diverting pulley would increase the contact angle by 180°. FIG. 2d presents a variant of the idea of the invention in which the ropes coming from the elevator car go directly to the traction sheave and not to a diverting pulley as in the preceding examples. From the traction sheave the ropes are passed over two diverting pulleys to the counterweight. In this solution, however, the wheelwork is not completely within the rope distance.

Figure 3:
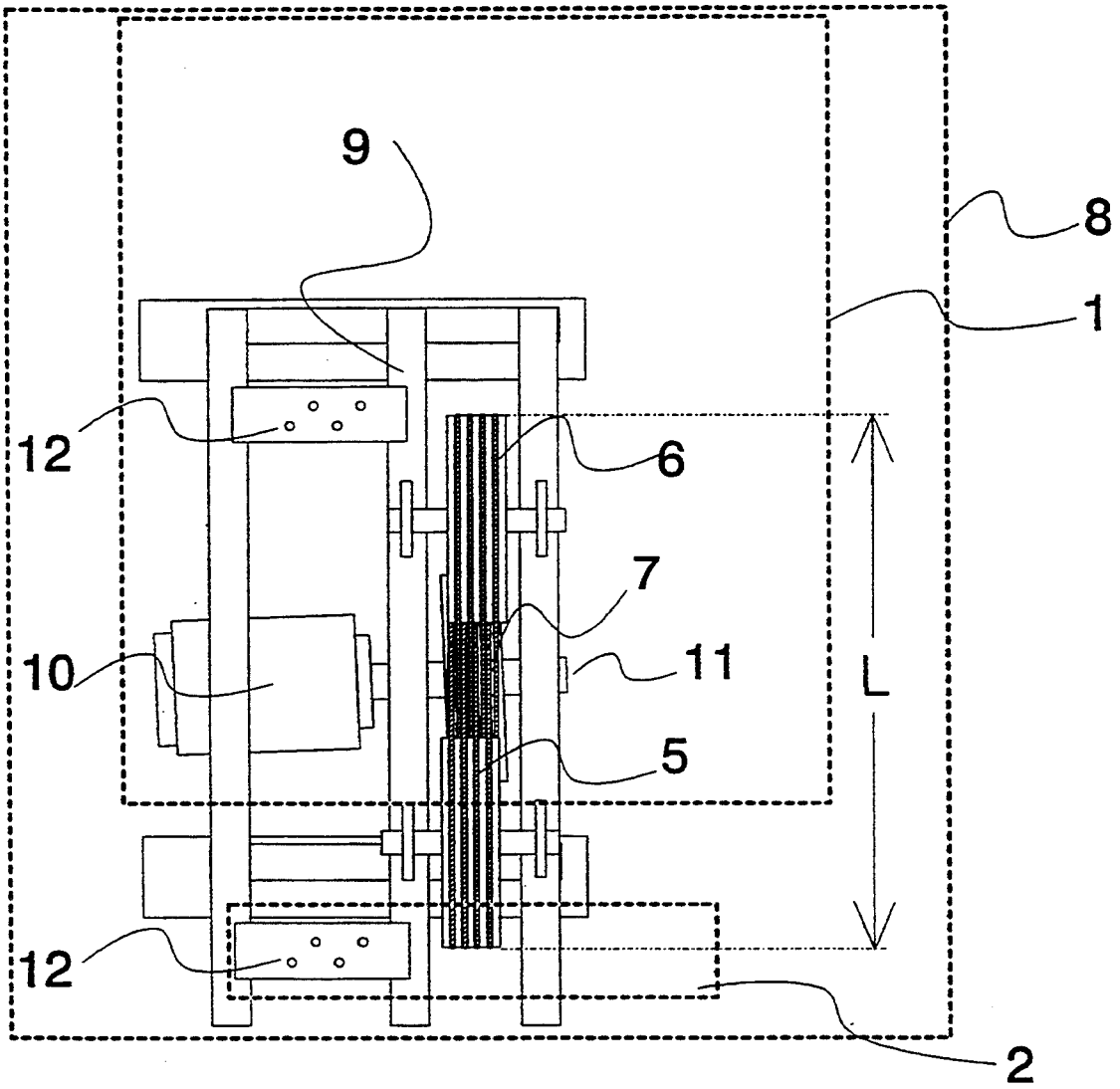
FIG. 3 presents the traction sheave elevator of the invention as seen from above.

FIG. 3 presents the traction sheave elevator of FIG. 1 in top view. The broken lines represent the positions of the elevator car 1 and counterweight 2 relative to the shaft 8. The diverting pulleys 5,6 are mounted with bearings on a framework 9 which also acts as a mounting bed for the traction sheave 7 and the drive machine 10. The shaft 11 of the traction sheave 7 is so oriented as if it had been turned horizontally from a position where it would have been parallel to the shafts of the diverting pulleys so that the hoisting ropes running crosswise to the diverting pulleys do not touch each other or themselves at the crossover point. The planes of rotation of the diverting pulleys are parallel to each other. The distances of the planes of rotation of the diverting pulleys from the traction sheave are so adapted that the hoisting ropes meet the diverting pulleys in the direction of the rope grooves, and that the skew traction angles towards each pulley are equal. In the case presented by the drawing, where the shaft of the hoisting machine continues directly as the shaft of the traction sheave, this means that the assembly of hoisting motor, hoisting machine, shaft and traction sheave has been turned horizontally about the vertical line passing through the center of the traction sheave 7 and then fixed to the bed 9, the shaft 11 being provided with a bearing.

As the traction sheave 7 and diverting pulleys 5,6 are all within the rope distance L, it is easy to produce a machine bed 9 of a length substantially equal to the rope distance or slightly exceeding it and of a width less than the length. The framework 9 used as a machine bed may even be shorter than the rope distance. Such a compact bed is particularly suitable for elevator modernization, especially if the framework is completely within the rope distance, because in this case the bed can be easily placed even in a narrow machine room, if necessary by turning the bed through 180° in the horizontal plane.

To allow the elevator car or the counterweight to be suspended on the rigging by means of a diverting pulley, the bed is provided with anchorages 12 for the free ends of the rigging. Each rope in the rigging runs in its own groove on the traction sheave so that the continuous contact angle on the traction sheave is in the range of 200°–270°. If the contact angle is below 200°, this will result in excessive distances between the wheels. A contact angle exceeding 270° would involve such large skew traction angles of the ropes relative to the traction sheave that the resulting fast rope wear would be unacceptable. With regard to wear, an acceptable practical maximum for the skew traction angle is about 2°, and angles exceeding 4° are completely unacceptable. If the contact angle is about 250°, reasonably short interwheel distances can be achieved without large skew traction angles. In a system of conventional dimensions, a contact angle of 250° involves a skew traction angle of about 1.2° for the rope leaving the groove of the rope pulley. For practical solutions, applicable contact angles are mostly in the range of 230°–260°, for which neither the interwheel distance nor the skew traction angle are very large. As the bed 9 can be easily provided with means for the adjustment of the rope distance L by using an arrangement where the diverting pulleys or at least one of them is movable in the lengthwise direction of the bed, the bed as well as the sizes and mutual distances of the traction sheave and diverting pulleys are preferably so dimensioned that the contact angle will remain within the advantageous range of 230°–260° even in the extreme positions of the range of adjustment of the rope distance.

It is obvious to a person skilled in the art that different embodiments of the invention are not restricted to the examples described above, but that they may instead be varied within the scope of the claims presented below.

It is also obvious to the skilled person that the invention could be utilized to obtain other advantages instead of an extended service life of the ropes. For instance, the ropes and the traction sheave and diverting pulleys could be designed to somewhat smaller dimensions, thereby reducing the costs. Reducing the size of the traction sheave would also reduce the torque required of the drive machine, thus allowing considerable economies to be achieved in the design of the machine. A smaller hoisting motor could be selected for the elevator. A smaller traction sheave means that the transmission ratio of a possible gear could be lower, which would further reduce the costs. It is also obvious that the rope distance determined by the wheelwork can be adjusted by varying the position of one of the diverting pulleys with respect to the other wheels.

Likewise, it is obvious to a person skilled in the art that the grip of the ropes on the traction sheave of the elevator of the invention can be improved by undercutting or otherwise shaping the rope grooves or by providing them with inserts made of polyurethane or other material having equivalent properties. The number of ropes used in the rigging is not essential to the invention and it may differ from that presented in the examples. Furthermore, it is obvious that, although the traction sheave and diverting pulleys presented in the drawings are of the same size regarding their diameters, in practical implementations the diamaters of the traction sheave and diverting pulleys may differ from each other, the diverting pulleys being often smaller than the traction sheave.

Figure 4:
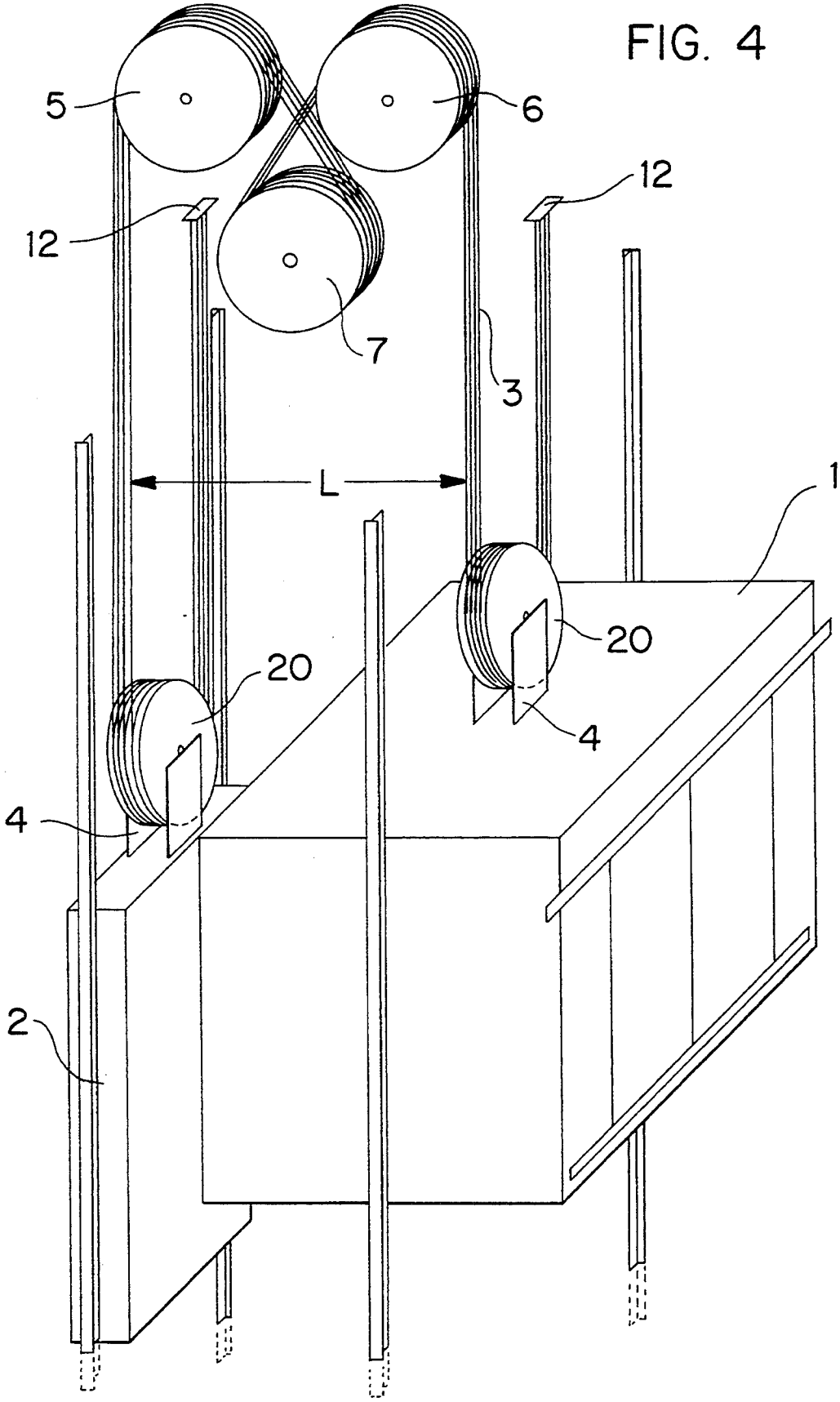
FIG. 4 presents the traction sheave elevator of the invention with the elevator car and counterweight being suspended to the rigging.

In the examples, the feature of the ropes running crosswise without touching themselves or each other has been achieved by turning the traction sheave horizontally through a certain angle and by appropriately placing the diverting pulleys. It is obvious that the traction sheave can also be tilted and that the planes of rotation of the diverting pulleys need not necessarily be parallel to each other. The suspension of the elevator car and counterweight on the rigging may differ from the above presentation e.g. in that at least one of them is suspended by means of a diverting pulley 20 as seen in FIG. 4. In this type of suspension, the free end of the rigging is fixed to the upper part of the elevator shaft or to a suitable point in the machine room, e.g. the machine bed. In this case, the rope speed is doubled as compared to the speed of the elevator car or counterweight suspended by means of a diverting pulley. The direction of rotation of the diverting pulley attached to the elevator car or counterweight may differ significantly from that of the wheels of the traction wheelwork, because the detriment to the rigging resulting from reverse deflections diminishes as the distance between the pulleys increases.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. Traction sheave elevator comprising a drive machine, a traction sheave provided with rope grooves and connected to the drive machine via a shaft, at least two diverting pulleys provided with rope grooves and each diverting pulley being rotatable about a shaft, an elevator car travelling along elevator guide rails, a counterweight travelling along counterweight guide rails and a hoisting rope rigging having at least one hoisting rope, on which rigging the elevator car and the counterweight are suspended and which rigging is so arranged that it passes via a wheelwork having the traction sheave and diverting pulleys and runs crosswise relative to itself, each deflection of each hoisting rope in the rigging takes place along a generally circular path determined by a rope groove in the traction sheave or a diverting pulley and occurs in essentially the same direction with respect to the direction of the shafts of the traction sheave and diverting pulleys, each rope in the rigging runs in a rope groove on the traction sheave so that there is a continuous contact angle on the traction sheave between 200–270 degrees.

2. Traction sheave elevator according to claim 1, wherein the continuous contact angle on the traction sheave is between 230°–260°.

3. Traction sheave elevator according to claim 1, wherein the elevator travels in an elevator shaft and wherein the planes of rotation of at least those diverting pulleys from which the rigging continues down into the elevator shaft are so arranged that each rope in the rigging meets the rope grooves of the diverting pulleys while running substantially in the direction of the plane of rotation of the diverting pulleys.

4. Traction sheave elevator according to claim 1, wherein the portion of the rigging going from the traction sheave towards the elevator car goes first to one of the diverting pulleys while the portion of the rigging going towards the counterweight goes first to another diverting pulley.

5. Traction sheave elevator according to claim 1, wherein the rigging comprises a diverting pulley so arranged that, in order to achieve a double-wrap contact, the ropes come to this pulley from the traction sheave of the elevator, then pass around said diverting pulley and continue back to the traction sheave.

6. Traction sheave elevator according to claim 1, wherein the elevator car travels in an elevator shaft, rope distance being adjustable by at least one of the diverting pulleys from which the rigging continues downwards into the elevator shaft being mounted on a bed so that the position of the diverting pulley can be varied with respect to the bed.

7. Traction sheave elevator according to claim 1, wherein the diverting pulleys are mounted with bearings on the same framework which also acts as a mounting bed for the traction sheave and the drive machine, and that the planes of rotation of the traction sheave and diverting pulleys and the directions of said planes are so selected relative to each other that the ropes running crosswise from the traction sheave to the diverting pulleys do not touch each other, and that the traction sheave and diverting pulleys are all between downwardly extending portions of the ropes, and that the mounting bed is provided with anchorages for the free ends of the ropes to allow the elevator car to be suspended on the rigging by a diverting pulley.

8. Traction sheave elevator according to claim 1, wherein the continuous contact angle on the traction sheave is about 250 degrees.

* * * * *